United States Patent [19]

Levine

[11] Patent Number: 4,557,672

[45] Date of Patent: Dec. 10, 1985

[54] ICE MACHINE PUMP REBUILD KIT

[76] Inventor: Fred Levine, 1290 NW. 74th St., Miami, Fla. 33147

[21] Appl. No.: 570,451

[22] Filed: Jan. 13, 1984

[51] Int. Cl.[4] ..... F04B 17/00; B63H 1/28; B64C 27/32

[52] U.S. Cl. ..... 417/360; 417/424; 415/DIG. 3; 416/244 R; 403/354

[58] Field of Search ..... 415/DIG. 3; 416/241 A, 416/244 A, 244 R; 417/424, 360; 403/289, 354, 371; 411/539, 544

[56] References Cited

U.S. PATENT DOCUMENTS

| | | | |
|---|---|---|---|
| 2,277,333 | 3/1942 | Leopold | 415/DIG. 3 X |
| 2,882,077 | 4/1959 | Marsh | 416/241 A X |
| 3,378,709 | 4/1968 | Royer et al. | 310/90 |
| 3,433,166 | 3/1969 | Birkemeier | 418/108 |
| 3,841,791 | 10/1974 | Doolin | 415/DIG. 3 X |
| 4,110,644 | 8/1978 | Roddy | 310/89 X |

FOREIGN PATENT DOCUMENTS

| | | | |
|---|---|---|---|
| 7626250 | 3/1978 | France | 403/354 |
| 52-40808 | 3/1977 | Japan | 416/241 A |

OTHER PUBLICATIONS

Worthington D-1000 New Standard End-Suction Pumps, Worthington PumpCorp., East Orange, NJ, 1975.

Worthington D-1100 Vertical In-Line Pumps, Worthington Pump Corp., East Orange, NJ, 1976.

*Primary Examiner*—William L. Freeh
*Assistant Examiner*—Theodore W. Olds
*Attorney, Agent, or Firm*—Harvey B. Jacobson; Clarence A. O'Brien

[57] ABSTRACT

An ice machine pump rebuild kit which enables a repair person to replace the electric motor for the pump and rebuild the pump by providing a kit which enables the drive motor and pump impeller to be replaced from a minimum inventory of replacement components. The kit includes a plurality of pump impellers constructed of plastic material having sufficient rigidity but yet enough flexibility to enable the impeller to slip over and frictionally engage the motor shaft with the impeller shank including a V-shaped slot oriented radially therein to enable the impeller shank to expand to receive and frictionally grip the motor shaft in a secure manner.

6 Claims, 10 Drawing Figures

ICE MACHINE PUMP REBUILD KIT

BACKGROUND OF THE INVENTION

1. Field of the Invention

The present invention generally relates to an ice machine pump rebuild kit and more specifically a kit to enable the pump impeller on an ice machine pump to be replaced when the motor which drives the ice machine pump is replaced with the kit including a plurality of impellers having different structural characteristics including a shank with a V-shaped slot therein to enable the shank, which is constructed of plastic material, to expand to receive the end of the motor shaft and frictionally grip and securely attach the impeller to the shaft without the use of fastening screws or other mechanical fastening devices. The kit enables a standard motor to replace a plurality of different types of motors now used on commercially available ice machine pumps thereby enabling a repairman to replace a failed motor from a substantially smaller inventory of components.

1. Description of the Prior Art

Ice making machines are now provided in many establishments for providing a supply of ice cubes and the like. Such machines employ a small water circulating pump for use in providing ice cubes or the like which are clear due to circulation of water in a well known manner. The ice machine pumps are driven by an electric motor and numerous different ice machine pumps are used by the various manufacturers of the ice machines. When a repairman is called to replace the electric motor which is the usual failure point, the repairman finds that the particular motor that is needed is not available on the repair truck since the space and investment required to stock so many components is prohibitive. The ice machine pumps include an impeller fastened to the motor shaft by various structural arrangements such as an axial, internally threaded socket in the end of the shaft with a screw and spring securing the impeller onto the shaft with the screw being threaded into the threaded socket. The various pumps commercially available have variations in the diameter and length of the shank of the impeller and the motor shaft also varies in length so that the impellers will properly fit in the pump housing. Thus, in order to replace the motor, it is necessary to replace it with a motor having the exact same dimensional characteristics as the original motor which requires a large inventory of motors to be available.

SUMMARY OF THE INVENTION

An object of the present invention is to provide a kit to enable an ice maker pump to be rebuilt with the kit including a motor and an impeller having a shank attached to the pump motor shaft in such a manner that a limited number of impellers may be provided to enable various types of pumps to be associated with a replacement motor thereby reducing inventory of component parts that a repairman must have available in order to repair the various ice making machines now being used.

Another object of the invention is to provide an ice maker pump rebuild kit which includes a plurality of replacement impellers, a dual voltage motor, fastener nuts, brass centering washers, motor cover and an O-ring seal for one particular type of ice machine pump which enables disassembly of the defective unit and reassembly of the pump components and replacement motor without the use of an exact duplicate motor and an exact duplicate pump assembly thereby enabling the kit to effectively replace motors and rebuild pumps in many various types of ice machines that are currently being used.

Still another object of the invention is to provide an ice machine pump rebuild kit which is simple in construction, easy to use, effective for rebuilding pumps in various types of ice machines and enables the inventory carried by a repairman to be greatly reduced thereby saving in space and investment cost.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
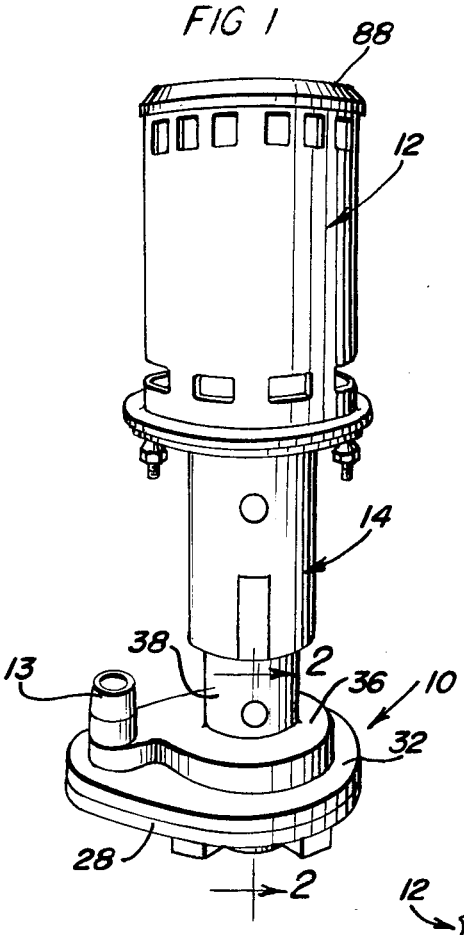
FIG. 1 is a perspective view of an ice machine pump and motor assembly.

FIG. 1 illustrates an assembly employed in an ice machine which includes a pump generally designates by numeral 10 which is driven by an electric motor generally designated by numeral 12 with the electric motor and pump being interconnected by a housing generally designated by numeral 14. This type of assembly is conventional in various types of ice making machines with this assembly being provided with a suitable bracket structure to support the unit properly in the cabinet of the ice making machine with the pump 10 including an inlet 11 and an outlet 13 connected into a water circulation system in a conventional manner. No changes are made in the overall operation of the motor and pump unit in the present invention which relates to the provision of a kit to enable the pump to be rebuild when a replacement motor is installed. In the operation of ice machines in various installations, such as motels, restaurants and the like, one of the most frequently occurring problems is failure of the drive motor for the pump. A repair person being called because of the ice machine failure will usually find that the pump motor has failed and may be faced with as many as 30 different types of ice machine pumps depending upon the manufacturer and type of ice machine that may be installed in a particular establishment. Each of the different types of ice machine pumps requires different components including different motors and different pump impeller structures and different drive shaft arrangements which renders it impractical from the standpoint of space and investment to stock a repair truck with a sufficient variety of components to satisfy every condition encountered. The kit of the present invention enables the various pumps to be rebuilt so that a standard motor can be utilized thus greatly reducing the inventory of components necessary in order to replace motors in various ice machines.

Most all of the pumps which are installed in ice machines include an impeller mounted on the drive shaft by the use of a screw and spring which passes through the impeller and threads into an internally threaded hole in the end of the pump shaft. While this same principle of attachment is used on all of the pumps, there are variations in the diameter and length of the impeller shank. Also, in various existing pumps, the motor shaft varies considerably in length so that the impellers will fit into the height of the specific pump housing 14.

The kit of the present invention includes a plurality of impellers, one of which is illustrated in FIGS. 2–5 and designated generally by numeral 16 and which includes a circular plate 18 having depending fins or vanes 20 integral therewith which terminate in a substantially straight outer edge 22 coincident with the outer periphery of the plate 18 and a downwardly and upwardly inclined inner edge 24 terminating in a straight bottom edge 26 joining the lower end of the inner edge 24 and the outer edge 22. Also, the fins or vanes 20 are arcuately curved as illustrated in FIG. 1 and the inner edges 24 of the fins 20 are spaced from the center of the plate 18 so that the lower end of the inner edges 24 are spaced outwardly from the inlet 11 but disposed adjacent the inlet 11 in the pump housing 10 which includes a bottom plate 28 having a depending boss 30 therein having the central inlet 11 formed therein. The housing 28 also includes a top plate 32 secured to the bottom plate 28 with a seal ring 34, such as an O-ring seal interposed therebetween. The top plate 32 includes an offset portion 36 which receives the impeller 16 and which includes an upwardly extending tubular member 38 forming part of the housing 14 and receiving the pump shaft 40 that is connected with the motor 12 in a conventional manner. The pump shaft 40 includes a flat surface 42 from its lower end for a substantial longitudinal distance with the impeller 16 being mounted on the shaft 40.

Figure 3:
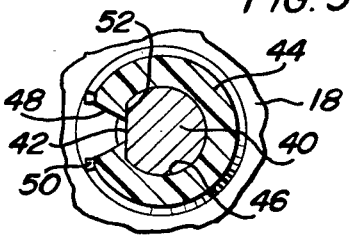
FIG. 3 is a sectional view taken substantially upon a plane passing along section line 3—3 on FIG. 2 illustrating the construction of the pump impeller shank in its relationship to the pump drive shaft.
Figure 6:
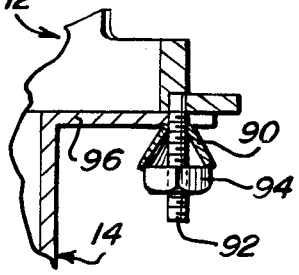
FIG. 6 is a sectional view of the connection between the motor and pump housing.
Figure 4:
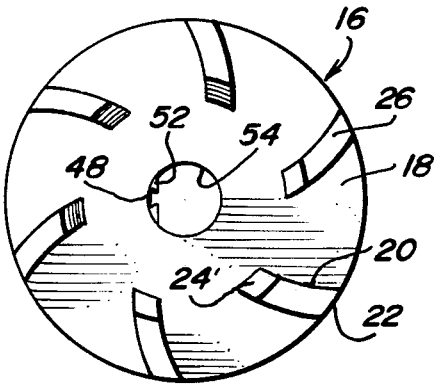
FIG. 4 is a bottom plan view of the impeller.
Figure 5:
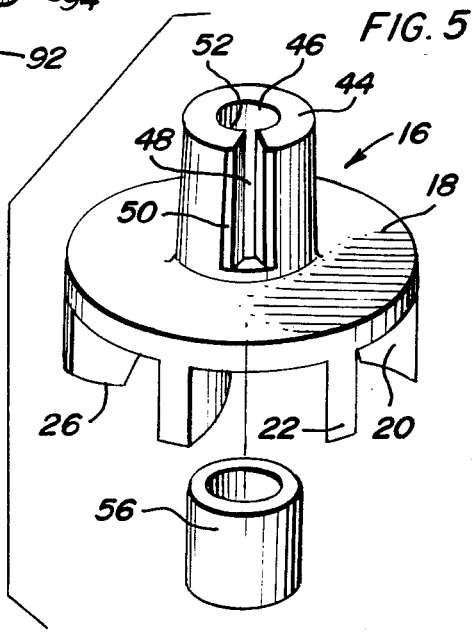
FIG. 5 is a perspective view of the impeller.
Figure 7:
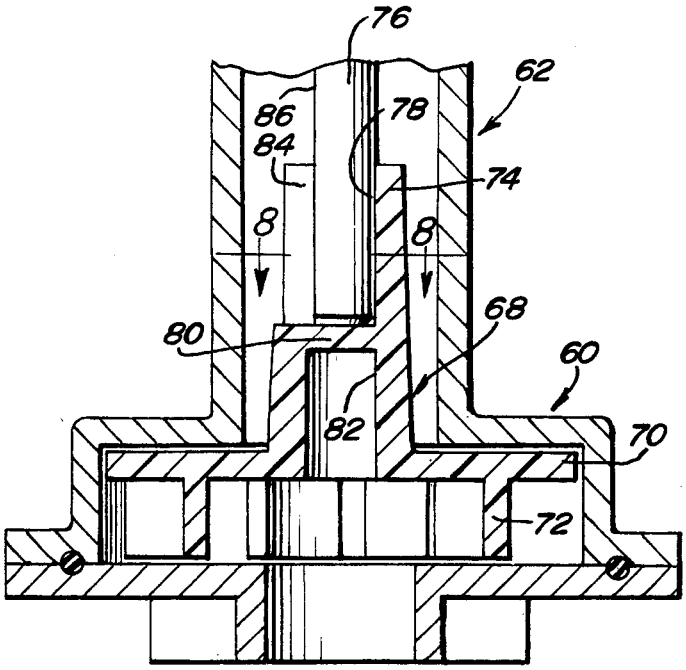
FIG. 7 is a sectional view illustrating another embodiment of the pump rebuild kit incorporated into a pump.
Figure 8:
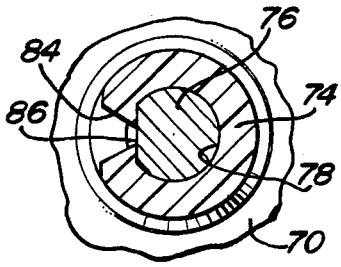
FIG. 8 is a sectional view taken substantially upon a plane passing along section line 8—8 on FIG. 7 illustrating the relationship of the impeller shank and drive shaft of this invention.
Figure 9:
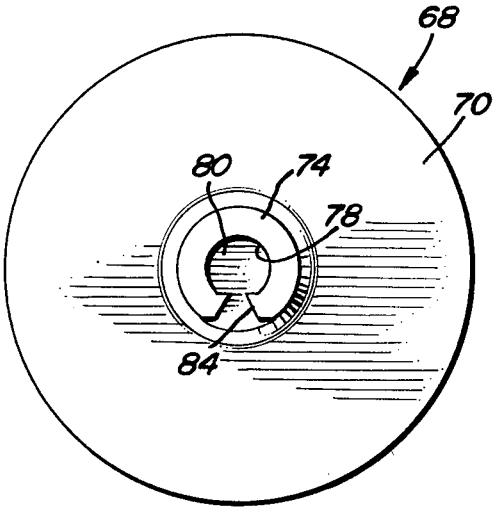
FIG. 9 is a top plan view of the impeller illustrated in FIG. 7.
Figure 10:
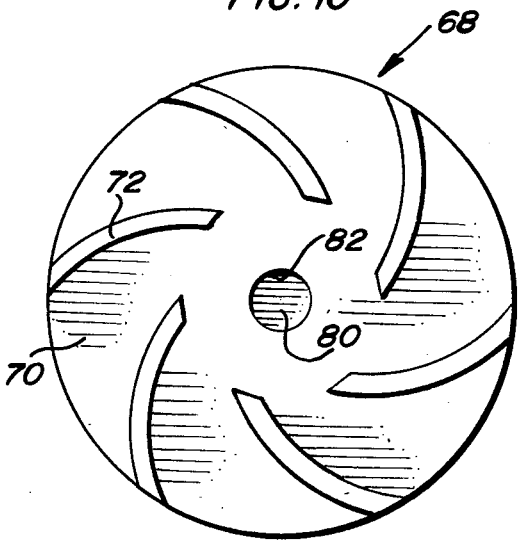
FIG. 10 is a bottom plan view of the impeller illustrated in FIG. 7.

The mounting structure for the impeller 16 includes a generally cylindrical shank 44 having a central opening or bore 46 therein which frictionally and slidably receives the shaft 40. The shank 44 includes an elongated longitudinal slot 48 extending from the upper end thereof downwardly to a position adjacent the plate 18. As illustrated in FIG. 3, the slot 48 is generally wedge-shaped in configuration with the sidewalls diverging radially outwardly with the outer corners of the slots being chamfered as at 50. Also, the bore 46 is provided with a transverse flat area 52 which has its center portion open and communicated with the inner edge of the slot 48 as clearly illustrated in FIG. 3 so that the flat portions 52 in the bore 46 on opposite sides of the slot 48 will engage the flat portion 42 on the shaft 40.

Figure 2:
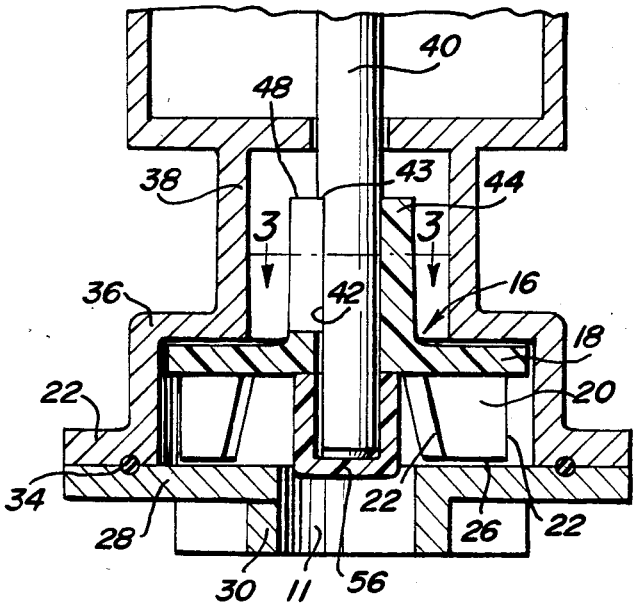
FIG. 2 is a sectional view of the pump taken along section line 2—2 of FIG. 1 illustrating one embodiment of the pump rebuild kit of the present invention incorporated therein.

As illustrated, the impeller 16 is attached to the shaft by slipping the shank 44 of the impeller 16 onto the shaft 40. The V-shaped slot 48 in the side of the impeller shank 44 allows the shank to expand to receive the shaft and holds the impeller tight on the shaft. The impeller is made of ABS plastic which is sufficiently rigid to hold the impeller tight on the shaft but yet sufficiently resilient to expand enough to receive the shaft 40 thereby providing a simplified manner of attaching the impeller 16 to the shaft 40. As illustrated in FIG. 2, the upper end of the shank 44 seats against the upper end 43 of the flat portion 42 on the shaft 40 thereby accurately positioning the impeller 16 on the shaft 40. In this embodiment of the impeller, the plate 18 is provided with an aperture 54 through which the lower end of the shaft 40 extends with the end of the shaft projecting below the plate 18. A plastic cap 56 is provided for engaging the lower end of the shaft by sliding the cap thereon. The cap 56 is constructed of similar plastic material and is dimensioned so that it will frictionally retain itself on the lower end of the shaft 40.

FIGS. 7–10 illustrate another embodiment of the impeller included in the rebuild kit of the present invention which is used in a similar pump 60 with a shaft housing 62 and motor in which the shaft housing 62 varies in length as compared to the housing 14 in FIG. 1. In this construction, the pump 60 also includes an inlet and outlet and substantially the same structure as in FIG. 2 except that the diameter and thus the capacity may vary. This embodiment of the impeller is generally designated by numeral 68 and includes a plate or disc 70 with depending fins or vanes 72 thereon constructed in a manner similar to that illustrated in FIG. 4 with it being pointed out that the number of vanes may vary, the arc of curvature thereof may vary as well as the length thereof with the head of the impeller being duplicative of various standard impellers now utilized in ice machine pumps. In this construction, the impeller 68 includes an elongated shank 74 which slips on and is attached to the shaft 76. The shank 74 includes a bore 78 receiving the shaft 76 and spaced downwardly from the upper end of the shank 74, a transverse partition 80 is provided which forms a closure for the bore 78 with the bore 78 continuing below the partition 80 as designated by numeral 82. The bore 78 is provided with a slot 84 and the shaft 76 is provided with a flat longitudinal side 86 so that the impeller, being constructed of the same material as the impeller disclosed in FIGS. 1–6 will slip on and be frictionally retained on the shaft 76. Impellers such as those shown in FIGS. 7–10 fit into pump housings which are much longer than those illustrated in FIGS. 1–6. The length of the shank 74 is much greater than that illustrated in FIGS. 1–6 and they seat against or on the end of the shaft itself and the inner end of the flat surface 86 on the shaft has nothing to do with the location of the impeller 68. The length of the stem is necessary to provide sufficient grip on the shaft and provide stability for the impeller 70.

Based upon commercially available ice machine pumps, four impellers will be provided in each kit although this number may vary. The impellers will have the attachment arrangement illustrated in FIG. 2 or the attachment arrangement illustrated in FIG. 7 with the diameter of the impeller as well as the size and location of the fins being varied and being duplicative of the existing pump impeller structure. The length of the shanks may vary with the embodiment illustrated in FIGS. 7–10 specifically being constructed to engage the shaft over a sufficient length to frictionally engage the impeller with the shaft and to stabilize the impeller with the partition 80 engaging the end of the shaft 76 to accurately position the impeller in relation to the pump housing.

The kit also includes an O-ring seal (not shown) which may be used types of pumps especially those having a side suction or intake. Also, a motor cover 88 and a pair of stainless steel hexagonal nuts and a pair of brass centering washers are provided in the kit with the centering washers 90 being positioned on the motor studs 92 to center the housing 14 for centering the pump impeller and pump housing so that that pump impeller will turn freely therein. The pump housing is retained in place by the hex nuts 94 with the pump housing including a flange 96 at the upper end thereof for mounting on the studs 92 as illustrated.

Inasmuch as some ice machines have 230 volt motors, the kit will include a motor having a dual voltage, either 115 or 230, so that the one motor can be properly connected into the circuit and properly operate regardless of whether the voltage supplied is 115 or 230.

In utilizing the kit, the repair person will first remove the bottom of the pump such as the plate 28 by removing the normally provided fasteners around the periphery of the pump housing in a well known manner thus exposing the impeller and the normally provided screw which extends into the end of the shaft for securing the impeller in place. The defective unit is then removed by removing the screw, spring and impeller as well as the motor and housing assembly with all washers, grommets and mounting brackets being retained. The electrical leads from the defective motor are cut close to the motor so that the wires can be used to provide a power supply to the new motor leads with the defective motor, impeller and screw being discarded.

The mounting bracket, if any from the old pump, is placed on the new motor shaft and the pump housing is placed on the motor followed by the impeller which is pressed down until the impeller seats. When using the impeller illustrated in FIGS. 1–6, the shaft will protrude into the vanes with the impeller stopping against the upper end of the flat. When the impeller illustrated in FIGS. 7–10 is used, the impeller will be stopped by the end of the shaft engaging the partition 80. The pump housing is then centered on the impeller with it being certain that the impeller turns freely. The pump housing is then fastened with the brass centering washers 90 and hex nuts 94. If the impeller such as illustrated in FIGS. 1–6 is used, the cap 56 is placed on the bottom end of the shaft and the bottom of the pump is reassembled. If the motor originally installed included a cover, a new cover 88 may be installed or the old cover can be used. The cover will be a plastic component configured to be placed on top of the motor with the motor cover being retained in place by foam tape having an adhesive securing surface that is protected by a tape that is removed before applying the cover to the motor.

By providing a kit in accordance with the present invention including the motor, motor cover, four impellers, a seal ring, two hex nuts and two brass washers, a repair person may replace the motor which was originally installed in the various types of ice machines which are commercially available thereby materially reducing the storage space required in the storage warehouse and in the vehicle which the repair person uses, and reducing substantially the cost of the inventory of components that otherwise would be necessary in order to provide proper service for the various ice machines.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An assembly for rebuilding an ice machine pump and motor assembly which includes a motor, pump and pump housing comprising an impeller having an impeller head including a circular plate and projecting vanes received in the pump housing and a longitudinally extending shank having a longitudinal bore therein, and a motor having a drive shaft with a longitudinal flat surface thereon, said impeller shank bore having a flat surface internally thereof engaged with the flat surface on the drive shaft to prevent relative rotation therebetween, said shank of the impeller including a longitudinal slot extending outwardly from the inner end thereof, said shank being constructed of substantially rigid but yieldable plastic material with the bore being dimensioned to slip onto the shaft with the shank being sufficiently expandable to frictionally grip the shaft to securely mount the impeller on the shaft.

2. The kit as defined in claim 1 wherein said bore in the impeller shank extends completely through the impeller with the shaft extending completely through the impeller with the inner end of the shank engaging and being stopped by the inner end of the flat surface on the shaft and a cap frictionally engaged over the outer end of the shaft where it extends through the impeller with the engagement of the shank with the inner end of the flat portion on the shaft accurately positioning the impeller in relation to the pump housing.

3. The kit as defined in claim 1 wherein said bore in the shank includes a partition forming a closure for the bore at the inner end of the slot whereby the closure partition accurately positions the pump impeller in relation to the pump housing.

4. An impeller for mounting on a pump shaft having a longitudinal flat surface, said impeller including an impeller head and a shank projecting therefrom, said shank including a bore having the same configuration as the pump shaft, an axially extending slot in the shank extending radially from the bore to the periphery thereof to enable the bore and shank to expand sufficiently to slip on the pump shaft and frictionally, fixedly grip the radially outer surface of the pump shaft for securing the impeller thereto and stabilizing the impeller thereon, said slot being substantially V-shaped in configuration and extending from the flat surface in the bore to the periphery of the shank with the inner edge of the V-shaped slot having a width less than the width of the flat portion of the bore thereby providing flat portions in the bore engaging the opposite side portions of the flat portion of the shaft.

5. The impeller as defined in claim 4 wherein said bore in the shank extends completely through the impeller to enable the inner end of the shank to engage and be limited by contact with the inner end of the flat surface on the shaft.

6. The impeller as defined in claim 4 wherein said bore in the shank is closed by a transverse partition coincident with the outer end of the slot for engaging the outer end of the shaft to limit the slip-on movement of the impeller onto the shaft for positioning the impeller on the shaft.

* * * * *